United States Patent [19]

Sachleben et al.

[11] Patent Number: 4,566,468

[45] Date of Patent: Jan. 28, 1986

[54] PROCESS AND SYSTEM FOR MAKING A BLENDED TOBACCO PRODUCT

[75] Inventors: Leroy R. Sachleben; Kevin R. Korte; Daniel D. Snyder, all of Louisville, Ky.; Terry L. Allen, North Augusta, S.C.

[73] Assignee: Brown & Williamson Tobacco Corporation, Louisville, Ky.

[21] Appl. No.: 498,000

[22] Filed: May 25, 1983

[51] Int. Cl.[4] ..... A24B 15/24; A24B 15/26

[52] U.S. Cl. ..... 131/297; 131/298; 131/291; 131/296

[58] Field of Search ..... 131/291, 296, 297, 298

[56] References Cited

U.S. PATENT DOCUMENTS

| | | | |
|---|---|---|---|
| 3,096,773 | 7/1963 | Neukomm | 131/298 |
| 3,612,066 | 10/1971 | Jones | 131/298 |
| 4,131,118 | 12/1978 | Gellatly | 131/297 |

*Primary Examiner*—V. Millin

*Attorney, Agent, or Firm*—Charles G. Lamb

[57] ABSTRACT

A process and apparatus for producing a smoking tobacco having a low nitrate content includes at least one stage through which a tobacco having a relatively high nitrate content, for example burley tobacco, continuously passes for continuous nitrate removal by dissolution. In the nitrate removal stage, a solvent is added to, for example, the burley tobacco to form a slurry. The free solvent, including dissolved nitrates, is decanted from the slurry leaving saturated burley tobacco. The saturated burley tobacco is subjected to an expression pressure to remove a further amount of solvent and dissolved nitrates therefrom. After the burley tobacco leaves the nitrate removing stage, it is mixed with another tobacco, such as, for example, a flue-cured tobacco. The tobacco mixture is then expanded and dried to a moisture content suitable for use in a smoking article. In order to provide a continuous uniform quantity of the tobacco mixture to the expanding-drying step, the mixture is bulked upon leaving the mixing step.

34 Claims, 3 Drawing Figures

PROCESS AND SYSTEM FOR MAKING A BLENDED TOBACCO PRODUCT

BACKGROUND OF THE INVENTION

1. Field of the Invention

The present invention relates to the treatment of smoking tobacco. In one respect, the present invention relates to the removal of nitrates, by dissolution, from tobacco, particularly burley tobacco. In a further respect, the present invention relates to the manufacture of a tobacco mixture for use in a smoking article.

2. Description of the Prior Art

It is known in the art to remove soluble undesirable material from smoking tobacco by use of a solvent.

For example, U.S. Pat. No. 3,145,717 issued on Aug. 25, 1964, to Osborne, et al, deals with a method of making a web of tobacco material and includes a water extraction step to separate water soluble constituents. This is accomplished by placing the tobacco in a closed tank with one to three parts of water per part of tobacco at 190° Fahrenheit for one to two hours. Afterward, the water soluble constituents are separated from the tobacco by draining, pressing or centrifuging. The extract is reapplied at a later step in the process after the extract has been acidified and neutralized with potassium carbonate.

U.S. Pat. No. 3,646,943 issued on Mar. 7, 1972, to Blewitt is directed to a method for making reconstituted tobacco wherein the tobacco stems are washed to remove tobacco solubles prior to refining. The stems are crushed and placed in a tank with water at a ratio of 10 parts of water of one part of flattened stems. This mixture is agitated and allowed to soak for at least a half hour. During this soaking period the stem material rises to the top and the tobacco liquor containing the tobacco solubles, such as nitrates, is drawn off from the bottom of the tank. As the tobacco liquor is removed, it is replaced with fresh water. The stem-water mixture is then refined.

U.S. Pat. No. 3,690,328 issued on Sept. 12, 1972, to Quarenghi is directed to wet processing tobacco stems wherein the stems are completely soaked for 30 to 60 minutes in water to dissolve soluble constituents. Subsequently, the stems are mechanically opened and allowed to drain to a moisture content of 80% and then dried.

U.S. Pat. No. 3,874,392 issued on Apr. 1, 1975, is directed to extracting nitrous oxides from tobacco by boiling the tobacco in water for 15 minutes. The tobacco is next pressed to remove excess moisture, spread out to separate the fibers, and dried by heated air.

Nitrate salts are more concentrated in burley tobacco than in other types of tobacco commonly used in cigarettes. It is sometimes desirable to remove the nitrate salts from the tobacco.

All of the above-discussed methods involve a substantial amount of soaking time and drying time. Therefore, they are not well suited to an efficient manufacturing process. In addition, extended soaking can adversely affect the tobacco by, for example, breaking it down to a pulpy mass. Furthermore, the drying steps require the expenditure of energy, increasing the costs of manufacture.

SUMMARY OF THE INVENTION

The present invention recognizes the desirability of removing nitrates from smoking tobacco and the shortcomings of the prior art in a manufacturing environment.

An object of the present invention is to provide a process and apparatus which effectively removes a majority of the nitrates from smoking tobacco in a short period of time and which is, therefore, well suited for manufacturing smoking articles.

Another object of the present invention is to provide a process for making a blended tobacco product of at least two different tobaccos.

More particularly, the present invention provides a process for making a blended tobacco product of at least two different tobaccos comprising the steps of extracting soluble material from a first one of the two different tobaccos by dissolution, mixing the first tobacco resulting from the extraction step with a second one of the two different tobaccos, expanding the tobacco mixture resulting from the bulking step, and drying the expanded tobacco mixture to a moisture content suitable for a smoking product.

The present invention, particularly, also provides a process for removing soluble material from tobacco comprising the steps of combining the tobacco and a first solvent to produce a first slurry, and removing most of the free solvent with dissolved solubles from the first slurry leaving saturated tobacco.

The present invention, particularly, further provides a apparatus for removing soluble material from tobacco including at least a first soluble material removing stage comprising an extraction tank in which tobacco to be treated is mixed with a first solvent to produce a first slurry, means for supplying the first solvent to the extraction tank, means for separating free solvent from the first slurry to produce saturated tobacco, and means establishing slurry flow communication from the extraction tank to the free solvent separating means.

BRIEF DESCRIPTION OF THE DRAWINGS

These and other features of the present invention will become even more clear upon reference to the following description in conjunction with the accompanying drawings.

DESCRIPTION OF THE PREFERRED EMBODIMENT

Figure 1:
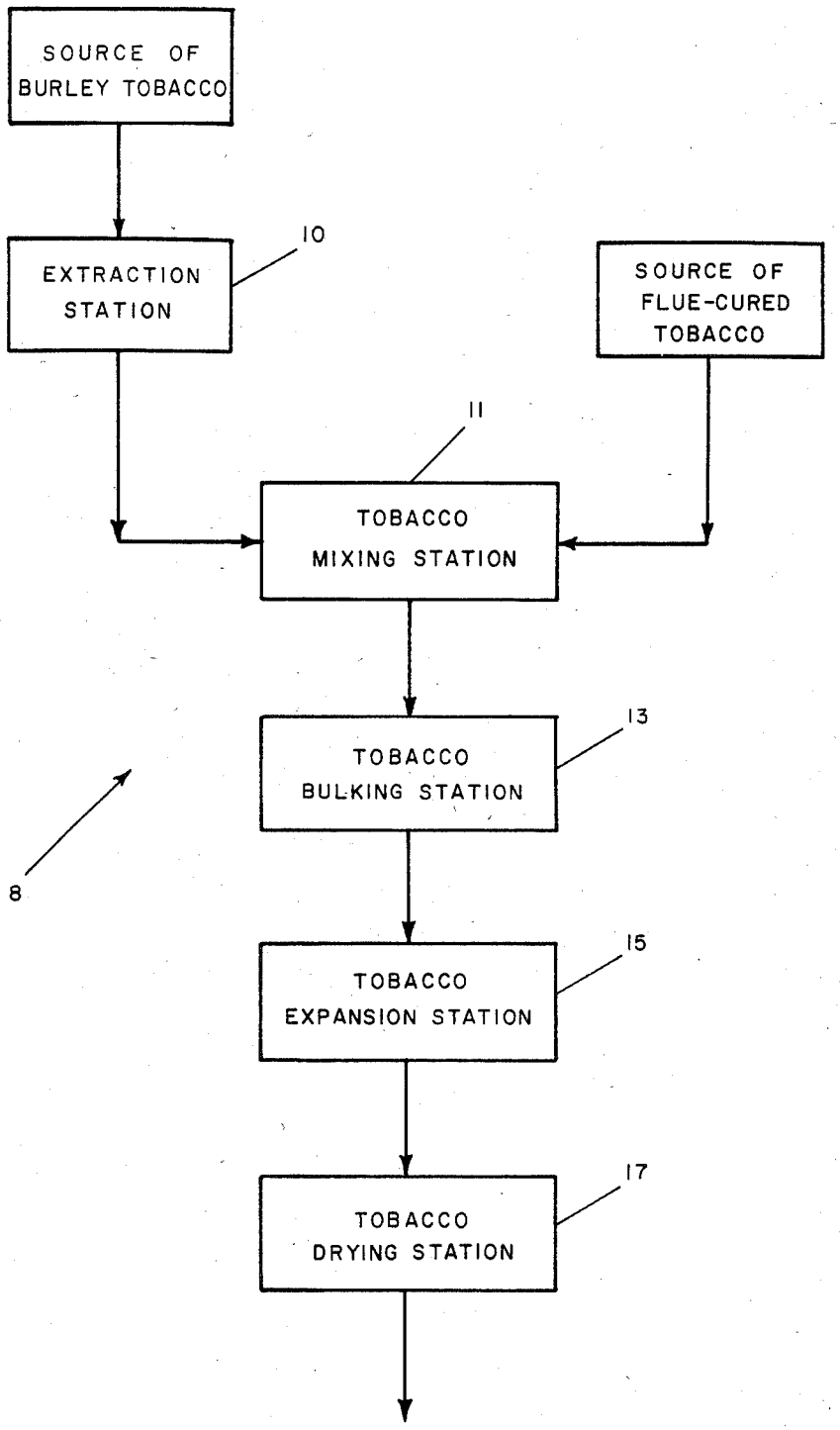
FIG. 1 is a schematic representation of a tobacco blending apparatus of the present invention for removing nitrates from a first type of tobacco and subsequently forming a tobacco blend by mixing the first tobacco with another type of tobacco.

With reference to FIG. 1, there is shown in schematic form, a system generally denoted by the number 8, for processing a blended tobacco suitable for use in a smoking article. A popular smoking tobacco blend comprises burley tobacco and a flue-cured tobacco. Preferably, the tobacco are tobacco stems, however, the tobacco can be a mix of tobacco stems and tobacco lamina.

The apparatus 8 comprises a nitrate extraction apparatus 10, a tobacco mixing station 11, a tobacco bulking station 13, a tobacco expansion station 15 and a tobacco drying station 17.

The burley tobacco from the extraction subsystem 10 having a moisture content of, for example, from about 45 to about 75 weight percent is mixed with a cut flue-cured tobacco product having a moisture content of, preferably, between about 30% and about 48% weight percent, in the tobacco mixing station 11 to produce a tobacco blend. If need be, the tobacco from the extraction apparatus 10 is reduced to an appropriate size for use in a smoking product by, for example, cutting or shredding before it is mixed with the flue-cured tobacco. The mixing station 11 can comprise virtually any known, or otherwise convenient mixing device. One such known mixing device is a tumbling apparatus which typically comprises a rotating housing enclosing mixing paddles which are attached to and, therefore, rotate with the housing to stir the tobacco components together in a tumbling action as the drum turns. The tobacco blend can include burley tobacco of from about 10% to about 90% of the blend and cut flue-cured tobacco of from about 90% to about 10% of the blend.

After the burley tobacco and flue-cured tobacco are thoroughly mixed together in the mixing station 11, the resulting tobacco blend is removed from the mixing station and bulked to provide a continuous, generally uniform quantity of the tobacco blend to the expansion station 15. The bulking station 13 can comprise virtually any known tobacco bulking apparatus. The bulking apparatus should allow the tobacco blend to remain relatively undisturbed for the required period of time before subsequent operations are performed. The bulking step typically takes 30 minutes or less. It has been found advantageous to use a belt-type endless conveyor for carrying out the bulking step. The belt-type endless conveyor allows the blended tobacco to remain in bulk form in an undisturbed condition while it is continuously moving the tobacco blend through the process from the mixing station 11 to the expansion station 15. The speed of the belt conveyor can be readily adjusted to provide an in-process inventory as it continuously moves the bulked tobacco blend from the mixing station 11 to the expansion station 15.

The tobacco blend is expanded by the application thereto of saturated steam. Virtually any known, or otherwise convenient tobacco expansion device can be used. It has been found advantageous, regardless of the type of expansion device used, to subject the tobacco mixture to at least 0.25 pounds of saturated steam at atmospheric conditions per pound of blended tobacco for at least 10 seconds to provide an increase in moisture of at least 2 weight percent to the tobacco blend.

Figure 2:
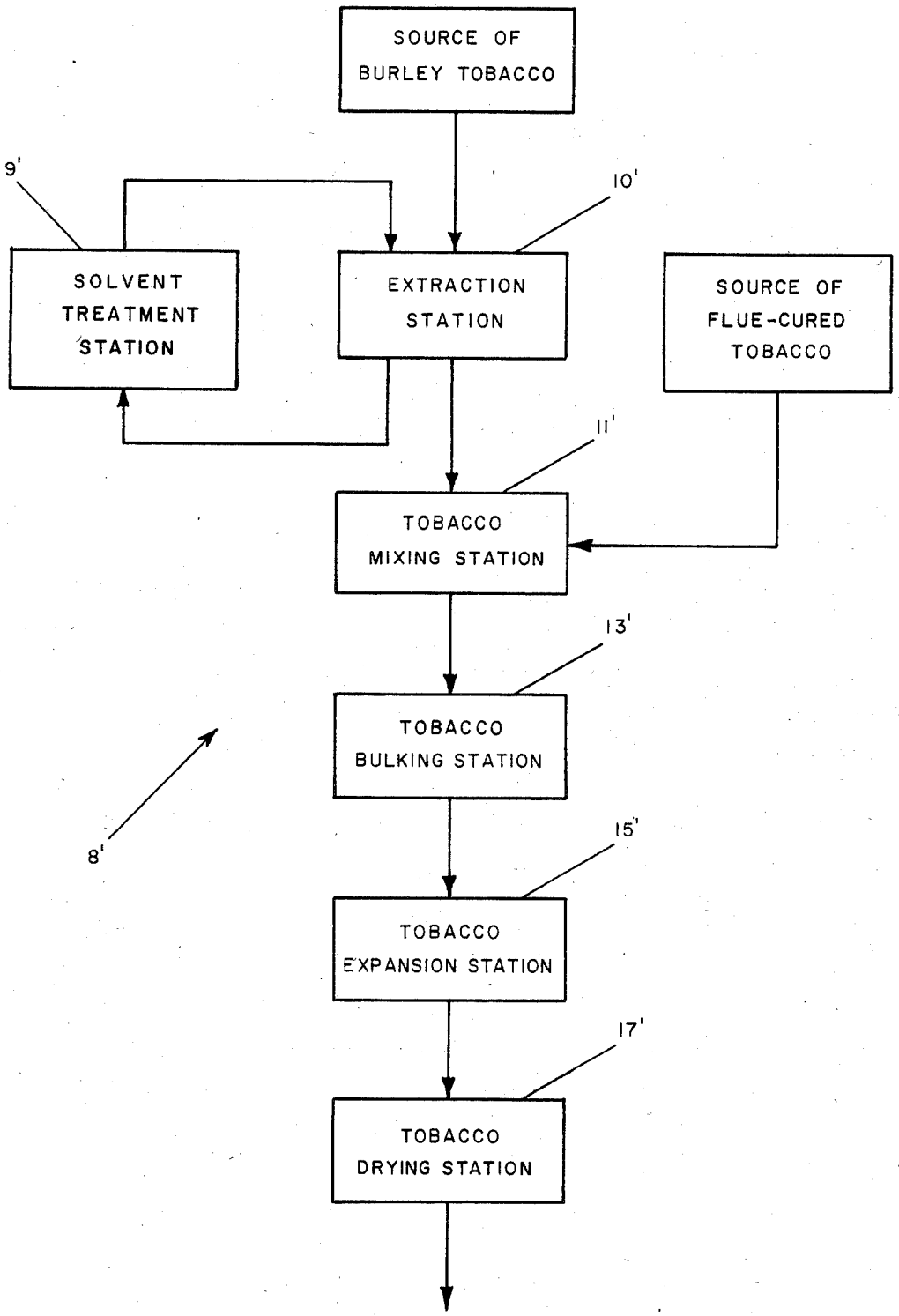
FIG. 2 is a schematic representation of another tobacco blending apparatus of the present invention for removing nitrates from a first type of tobacco and subsequently forming a tobacco blend by mixing the first tobacco with other types of tobacco; and, FIG. 3 is a schematic representation of a soluble material extraction apparatus of the blending system of FIG. 1 for continuously carrying out the nitrate extraction process of the present invention.

After the tobacco blend has been expanded, it is dried. The tobacco drying station can comprise virtually any known or otherwise convenient apparatus for drying tobacco. Typical drying apparatus use heated air or superheated steam to dry the tobacco as the tobacco is conveyed by the heated air or steam stream through a drying chamber or series of drying chambers. In the system of FIGS. 1 and 2, drying air at a wet bulb temperature of from about 150° F. to about 211° F. is used to dry the tobacco blend to a moisture content of from about 60 weight percent to about 5 weight percent.

The dryed, expanded tobacco blend is removed from the drying station 17 for further processing into a finished tobacco product suitable for a smoking article. Further processing can include adding an additional tobacco to the dryed, expanded tobacco blend and drying this tobacco mixture to a moisture content suitable for a smoking article, for example, between about 5% and 18% moisture content by weight.

With reference to FIG. 2, there is shown, in schematic form, another apparatus, generally denoted by the number $8^1$ for processing blended tobacco for use in a smoking article.

The system $8^1$ comprises an extraction apparatus $10^1$, a solvent treatment station $9^1$, a tobacco mixing station $11^1$, a tobacco bulking station $13^1$, a tobacco expansion station $15^1$ and a tobacco drying station $17^1$.

In the nitrate extraction substation $10^1$, tobacco, for example, burley tobacco is subjected to a wash of solvent such as, for example, water. The solvent containing dissolved nitrates, as well as other soluble material is removed from the tobacco and routed from the extraction substation $10^1$ to the treatment station $9^1$. The tobacco, having a moisture content of, for example, from about 45 to 75 weight percent is processed through the mixing station $11^1$, bulking station $13^1$, expansion station $15^1$ and drying station $17^1$ as in the corresponding stations of the system 8 of FIG. 1 hereinabove discussed and, therefore, to avoid redundancy the discussion will not be repeated. In the solvent treatment station $9^1$ the dissolved nitrate is removed from the solvent liquor and are appropriately disposed of. The dissolved nitrates can be removed from the solvent liquor by any number of methods such as, for example, evaporating the liquid solvent, precipitation or ion exchange. The now essentially nitrate free solvent liquor, containing other dissolved materials, is recycled back to the extraction substation $10^1$ where it is used as the solvent wash to remove nitrates from a new batch of tobacco.

Figure 3:
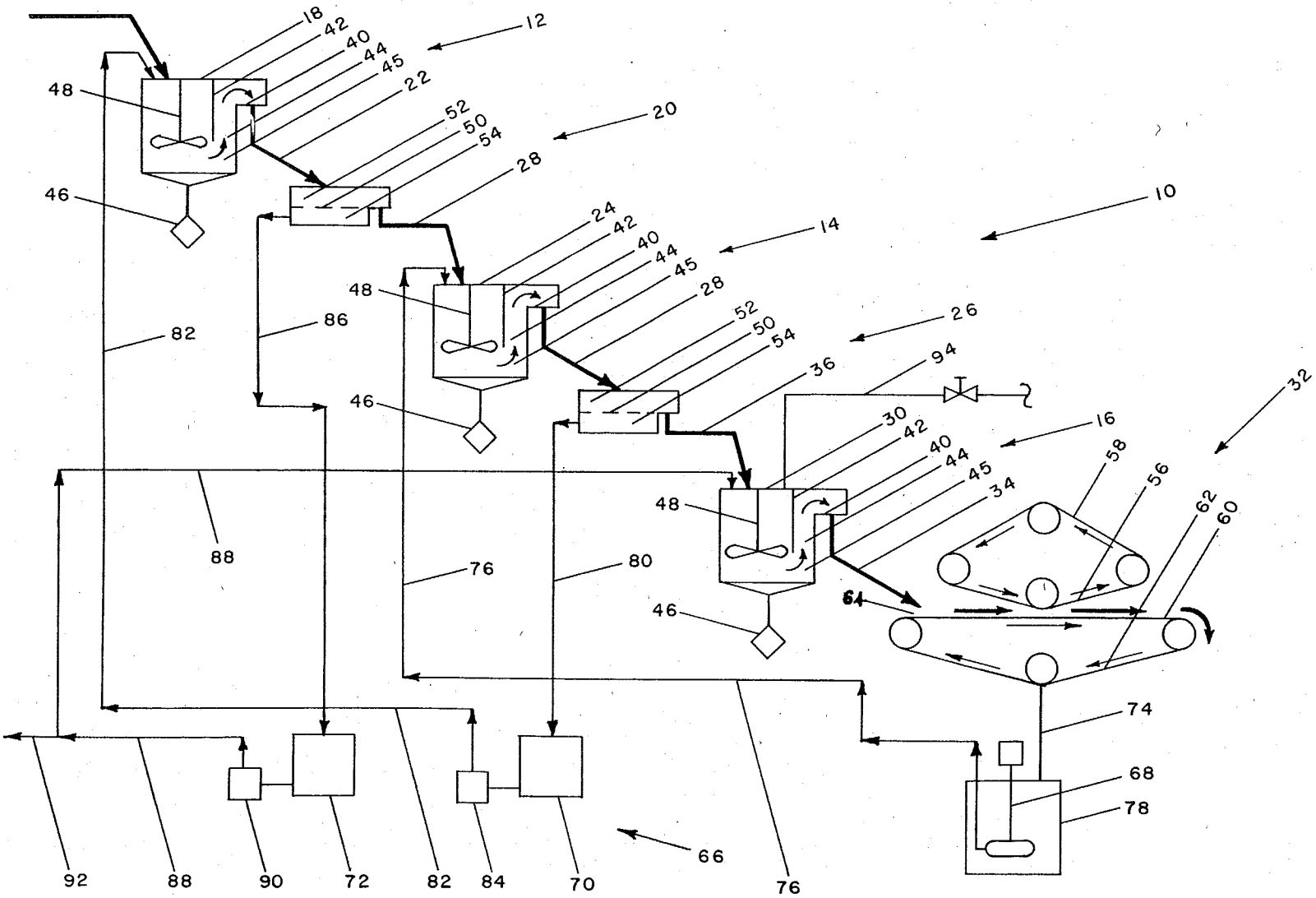

FIG. 3 schematically illustrates the apparatus 10 which is particularly adapted for removing soluble material; such as nitrate salts, from tobacco, particularly burley tobacco.

By way of example, the subsystem 10 is illustrated as comprising a plurality of sequential extraction stages. However, the number of extraction stages is a function of the amount of nitrate initially in the tobacco to be processed, and the amount to be removed from the tobacco and can, therefore, comprise one or more extraction stations as may be required for a particular set of circumstances. The apparatus 10 is illustrated as comprising three sequential extraction stages; a first stage 12, and second stage 14, and a third stage 16.

The first stage 12 is illustrated as comprising an extraction tank 18, wherein burley tobacco stems and a nitrate solvent, such as water, are mixed to form a slurry, and a vibratory screen device 20 in communication with the extraction tank 18 by means of, for example, a conduit 22.

The second stage 14 is shown as being virtually identical to the first stage and comprises an extraction tank 24 for mixing a nitrate solvent with saturated tobacco received from the first stage 12, and a vibratory screen device 26 in communications with the extraction tank 24 by means of, for example, a conduit 29. The extraction tank 24 of the second stage 14 is in flow communications with the vibratory screen device 20 of the first stage 12 by saturated tobacco conveying means 28 such as, for example, a conveyor belt device.

The third stage 16 is illustrated as comprising an extraction tank 30, which is substantially identical to the extraction tanks 18 and 24, for mixing a nitrate solvent with saturated burley tobacco received from the second stage 14, and tobacco expression means such as a belt press apparatus 32 in flow communication with the extraction tank 30 by means of, for example, a conduit 34. The extraction tank 30 of the third stage 16 is in flow communication with the vibratory screen device 26 of the second stage 14 by saturated tobacco conveying means 36 such as, for example, a conveyor belt device.

For the reason that the extraction tanks 18, 24 and 30 of the first, second and third stages, respectively, are illustrated as being virtually identical, the following description applies equally to each tank 18, 24 and 30.

The extraction tank includes an adjustable weir 38 at an outlet 40 from the tank, and a baffle 42 located next to the weir and cooperating therewith to define a slurry exit passageway 44 in the extraction tank. The baffle 42 terminates above the bottom wall of the tank defining an extrance 45 into the passageway 44 between the bottom edge of the baffle 42 and bottom wall of the tank. The exit from the passageway 44 is at the top edge of the weir 38 and communicates with the outlet 40 from the tank. The tank further includes a valved drain 46 for selective draining of the tank. Agitating means, such as a mechanical agitator 48 is located in the tank outside the passageway 44 to mix the tobacco and solvent components comprising the slurry in the tank.

The vibrating screen devices 20 and 26 of the first and second stages 12 and 14, respectively, are illustrated as being virtually identical and, therefore, the following description is equally apt for both. The screen device can be virtually any type; many of which are commercially available. The illustrated vibratory screen device comprises a vibrating screen 50 with a reservoir 52 defined above the screen 50 and a sump 54 defined below the screen 50. The conduit 22 between the extraction tank 18 and the screen device 20 of the first stage 12 communicates at its exit end with the reservoir 52 of the screen device 20 and, similarly, the conduit 29 between the extraction tank 24 and the screen device 26 of the second stage 14 communicates at its exit end with the reservoir 52 of the screen device 26. The saturated tobacco conveying means 28 between the screen device 20 of the first stage 12 and the extraction tank 24 of the second stage 14 communicates with the reservoir 52 of the screen device 20, and the saturated tobacco conveying means 36 between the screen device 26 of the second stage 14 and the extraction tank 30 of the third stage 16 communicates with the reservoir 52 of the screen device 26.

The press belt apparatus 32 can be of virtually any design. As shown, the press belt apparatus 32 comprises two endless belts arranged one above the other with the bottom flight 56 of the top belt 58 in overlaying relationship with the top flight 60 of the bottom belt 62. The belts 58 and 62 are driven in such a direction that the bottom flight 56 of the top belt 58 and the top flight 60 of the bottom belt 62 move in the same linear direction. As depicted, the top belt 58 is shorter than the bottom belt 62 and is positioned relative to the bottom belt 62 to expose a portion of the top flight 60 of the bottom belt. This exposed portion is a free drain area 64 and is located at the outlet from the conduit 34 communicating with the outlet 40 of the extraction tank 30 of the third extraction stage 16. It should be further noticed in FIG. 3 that the bottom flight 56 of the top belt 58 converges toward the top flight 60 of the bottom belt 62 in the direction of movement of the belts to a position generally at the longitudinal center of the top flight 60 where the space between them is minimal and then diverges in the direction of movement of the belts. This provides a converging channel to the point of minimum clearance and a diverging channel away from the point of minimum clearance.

The extraction apparatus 10 further comprises a solvent flow system, generally denoted as the number 66, for supplying solvent to each of the extraction tanks 18, 24 and 30. The solvent flow system 66 provides for the recycling and reuse of much of the solvent.

In the illustrative example of FIG. 3, the solvent flow system 66 comprises three solvent sumps 68, 70 and 72 each interconnected in solvent flow communication between different pairs of the solvent extraction stages for receiving solvent from one solvent extraction stage and recycling it to another one of the extraction stages. For example, as illustrated in FIG. 3, the solvent sump 68 receives used solvent from the third stage 16 and delivers it to the second stage 14, the solvent sump 70 receives used solvent from the second stage 14 and delivers it to the first stage 12, and the solvent sump 72 receives used solvent from the first stage 12 and delivers at least a portion of the solvent to the third stage 16 while routing the balance of the used solvent for disposal outside the subsystem 10. Toward this end, the solvent sump 68 is in solvent flow communication with the press belt apparatus 32 through a solvent drain conduit 74, and is in solvent flow communication with the top region of the extraction tank 24 of the second extraction stage 14 through a solvent supply conduit 76. The solvent drains from the press belt apparatus 32 through the drain conduit 74 to the sump 78 and is pumped to the extraction tank 24 through the solvent supply conduit 76 by a sump pump 78 located within the sump 78. In a similar manner, the sump 70 is in solvent flow communication with the screen sump 54 of the vibratory screen device 26 of the second stage 14 through a drain conduit 80, and is in solvent flow communication with the top region of the extraction tank 18 of the first extraction stage 12 through a solvent supply conduit 82. The solvent drains from the vibrating screen device 26 through the drain conduit 80 to the sump 70 and is pumped to the extraction tank 18, by a sump pump 84 associated with the sump 70, through the supply conduit 82. Likewise, the sump 72 is in solvent flow communication with the screen sump 54 of the vibratory screen device 20 of the first stage 12 through a drain conduit 86 and is in solvent flow communication with the top region of the extraction tank 30 of the third extraction stage 16 through a solvent supply conduit 88. The sump 72 is also in solvent flow communication with a solvent disposal flow conduit 92 for the disposal of some of the used solvent received from the first stage outside the apparatus 10. The solvent drains from the vibratory screen device 20 through the drain conduit 86, and the fraction of the solvent not removed through the disposal flow conduit 92 is pumped to the extraction tank 30 through the conduit 88 by a sump pump 90 associated with the sump 72. The solvent flow system 66 also includes a fresh solvent make-up conduit 94 for adding fresh solvent at the extraction tank 30 in the third stage 16.

In operation, burley tobacco stems, for example, to be treated are fed into the extraction tank 18 of the first stage 12 which contains a nitrate solvent recycled from the second stage 14. The burley tobacco stems are added to the tank 18 in a proportion of about 1 pound of dry tobacco stems to from between about 15 to about 20 pounds of solvent to form a first resulting slurry. This ratio provides satisfactory flow of the first resulting tobacco-solvent slurry. Preferably, the tobacco stems are added to the vortex formed in the solvent by the agitating means 48 so that the tobacco and solvent are thoroughly mixed to form the first resulting slurry. The first resulting slurry moves downwardly in the extraction tank 18 passing out the side of the extraction tank at opening 45 and into the slurry exit passageway 44. The first resulting slurry flows over the adjustable weir 38, through the outlet 40 and into the conduit 22 which conveys the first resulting slurry to the reservoir 52 of the vibrating screen device 20. As the vibrating screen 50 of the screen device 20 vibrates, most of the free solvent is separated from the first resulting slurry. The separated solvent, now containing dissolved nitrates, passes through the screen 50 and into the screen sump 54 below the screen 50 leaving saturated tobacco stems in the reservoir 52 above the screen 50. The saturated tobacco stems preferably have a solvent to tobacco stem ratio of about 5.7 pounds of solvent to about 1 pound of dry tobacco stems, or about an 85% moisture content. The separated solvent passes from the screen sump 54 of the screen device 20 through the conduit 86 to the solvent sump 72. A portion of the separated solvent from the first resulting slurry is pumped from the solvent sump 72 through the conduit 88 and is introduced into the extraction tank 30 of the third stage 16 with a quantity of fresh solvent from the conduit 94, while the balance of the separated solvent from the solvent sump 72 flows through the solvent disposal conduit 92 for disposal outside of the subsystem 10. The saturated tobacco stems pass from the reservoir 52 of the screen device 20 by conveying means 29, and is introduced into the extraction tank 24 of the second stage 14 wherein the saturated tobacco stems are added to the vortex formed in the solvent recycled from the third stage 16 by the agitating means 48. Again, the proportion of tobacco stems to solvent in the extraction tank 24 is about 1 pound of dry tobacco stems to between about 15 to about 20 pounds of solvent to provide a second resulting slurry. The second resulting slurry moves downwardly in the extraction tank 24 passing out the side of the extraction tank 24 at opening 45 and into the slurry exit passageway 44. The second resulting slurry flows over the adjustable weir 38 through the outlet 40 and into the conduit 28 which conveys the second resulting slurry to the reservoir 52 of the vibrating screen device 26. As the vibrating screen 50 of the screen device 26 vibrates, most of the free solvent is separated from the second resulting slurry. The separated solvent, now containing dissolved nitrates, passes through the screen 50 and into the screen sump 54 below the screen 50 leaving saturated tobacco stems in the reservoir 52 above the screen 50. The saturated tobacco stems have a solvent to tobacco stem ratio of about 5.7 pounds of solvent to about 1 pound of dry tobacco stems. The separated solvent passes from the screen sump 54 of the screen device 26 through the conduit 80 to the solvent sump 70. The separated solvent from the second slurry is pumped from the solvent sump 70 through the conduit 82, and is introduced into the extraction tank 18 of the first stage 12. The separated solvent is mixed with tobacco stems in the extraction tank 18 to form the first resulting slurry as hereinabove discussed. The saturated tobacco stems pass from the reservoir 52 of the screen device 26 by conveying means 36, and is introduced into the extraction tank 30 of the third stage 16 wherein the saturated tobacco stems are added to the vortex created by the agitating means 48 in the solvent comprising solvent recycled from the first stage 12 and fresh solvent contained in the extraction tank 30. As was the case in both the first and second stages, the proportion of tobacco stems to solvent in the extraction tank 30 is about 1 pound of dry tobacco stems to between 15 to about 20 pounds of solvent to provide a third resulting slurry. The third resulting slurry moves downwardly in the extraction tank 30 passing out the side of the extraction tank 30 at opening 45 and into the slurry exit passageway 44. The third resulting slurry flows over the adjustable weir 38 through the outlet 40, and into the conduit 34 which conveys the third resulting slurry to the free drain area 64 of the press belt apparatus 32 which free solvent is allowed to drain through the bottom belt 62 leaving saturated tobacco stems on the belt 62. The saturated tobacco stems move with the bottom belt 62 on the top flight 60 into the converging channel defined between the top and bottom belts. As the saturated tobacco stems move through the converging channel, additional solvent is mechanically squeezed out providing a burley tobacco product of reduced nitrate content exiting the diverging channel of the press belt apparatus 32 having a solvent to tobacco stem ratio of between about 1.5 pounds to about 1.9 pounds of solvent per pound of dry tobacco stems or about a 62% moisture content. The moisture content of the tobacco product can be adjusted by, for example, changing the expression pressure exerted on the saturated tobacco by the press belt apparatus 32. It has been determined that a moisture content of between about 45 to about 75 weight percent is preferred. The solvent draining from the third resulting slurry at the free drain area 64, and the solvent squeezed out in the converging channel of the press belt apparatus 32, passes through the drain conduit 74 to the sump 78. The separated solvent from the third resulting slurry is pumped from the solvent sump 78 through conduit 76, and is introduced into the extraction tank 24 of the second stage 14, wherein it is combined with saturated tobacco stems to form the second resulting slurry as discussed above.

To summarize the counter-current flow of the solvent in the flow system 66, the solvent supplied to the extraction tank 18 of the first stage 12 is in fact the solvent containing extracted nitrates removed from the second resulting slurry by the vibrating screen device 26 of the second stage 14, and the solvent supplied to the extraction tank 24 of the second stage 14 is in fact the solvent containing extracted nitrates removed from the third resulting slurry at the press belt device 62. The solvent supplied to the extraction tank 30 of the third stage 16 is a combination of solvent containing extracted nitrates removed from the first resulting slurry by the vibrating screen device 20 of the first stage 12 and fresh solvent supplied to the extraction tank 30 through conduit 94. Preferably, in the third stage 16, fresh solvent is supplied to the extraction tank at a metered rate of about 8 pounds of fresh solvent to about 1 pound of dry tobacco stems. Thus, the extracted solvent supplied to the various stages of the soluble material removal system flows in an opposite direction or counter-current to the flow direction of the tobacco slurry as it is being processed through the various extraction stages.

It should be understood that the use of three stages in the extraction apparatus 10 shown and discussed is given by way of example, and is not to be understood as limiting the present invention for the reason that, as previously mentioned, the number of stages used in actual practice will be a function of the initial percent of nitrates in the tobacco to be processed and the amount of nitrates to be extracted. Likewise, the nitrates remaining in the tobacco of the final tobacco product exiting the diverging channel of the press belt apparatus 32 under a given set of operating conditions will, of course, depend upon the beginning nitrate content of the tobacco stems.

The extraction process of the present invention provides for minimal residence time for the tobacco stems in a slurry. For example, in the above described subsystem 10, beginning with burley tobacco stems having an initial nitrate salt concentration of about 6.3%, the extraction or residence time of the tobacco is less than five minutes, and the nitrate concentration of the tobacco stems in the tobacco product leaving the press belt apparatus 32 will be less than 1% by weight of dry tobacco stems.

The counter-current recycling of the removed solvent between, and reuse of the solvent, in the various extraction stages of the present invention results in the solvent having the least concentration of removed nitrates being used to extract nitrates from tobacco stems having the lowest concentration of nitrates. Therefore, efficient nitrate extraction is maintained throughout the system and process while requiring a minimum of fresh solvent to be added to the continuing nitrate removal process thereby resulting in a substantial saving of solvent, and, therefore, operating expense. In fact, when water is used as a solvent, the recycling system makes it possible to operate the nitrate extraction process in locals where, or at times of the year when, the water supply would be otherwise inadequate to the task.

The present invention provides a process and apparatus for removing soluble material from tobacco, particularly suitable for removing nitrate salts from burley tobacco, in a continuous, uninterrupted operation, and further provides a process and apparatus for manufacturing either one type of tobacco or a tobacco blend of at least two different types of tobacco wherein the tobacco components are blended together after soluble material has been extracted from one of the tobacco components.

An unexpected and advantageous result of the process of the present invention is that the fill volume of the blended tobacco product, as measured by the volume of a unit weight of the blended tobacco product (cc/g), produced by the present invention is greater than the fill value of a tobacco blend of the same tobacco components, and weight ratio, produced by separately processing the tobacco components through the expansion and drying stages and then mixing the separately processed tobacco components together to produce the tobacco blend.

The foregoing detailed description is given primarily for clearness of understanding and no unnecessary limitations are to be understood herefrom for modifications will become obvious to those skilled in the art upon reading this disclosure and can be made without departing from the spirit of the invention or scope of the appended claims.

What is claimed is:

1. A process for making a blended tobacco product of at least two different tobaccos, said process comprising the steps of:

extracting soluble material from a first one of the two different tobaccos by dissolution;

mixing the first tobacco resulting from said extraction step with the second one of the two different tobaccos;

expanding the tobacco mixture resulting from the mixing step; and, drying the expanded tobacco mixture to a moisture content suitable for a smoking product.

2. The process of claim 1, further comprising adjusting the moisture content of the first tobacco resulting from the extraction step to from about 45 weight percent to about 75 weight percent.

3. The process of claim 1, wherein the second tobacco to be mixed with the first tobacco has a moisture content of between about 30 weight percent and about 48 weight percent.

4. The process of claim 1, wherein said expansion step comprises subjecting the bulked tobacco mixture to steam.

5. The process of claim 1, further comprising the step of reducing the size of the first tobacco resulting from the extraction step prior to mixing the resulting first tobacco with the second one of the tobaccos.

6. The process of claim 1 wherein the expansion step and drying step are simultaneously performed.

7. The process of claim 1, wherein said drying steps comprises subjecting the expanded tobacco mixture to a stream of hot gas at between about 150° F. wet bulb temperature and about 211° F. wet bulb temperature.

8. The process of claim 1, wherein said tobacco mixture is dryed to a moisture content of between about 5 weight percent and about 60 weight percent.

9. The process of claim 1, further comprising the step of bulking the first and second tobaccos prior to the expansion step.

10. The process of claim 1, wherein the tobacco mixture is expanded by subjecting the tobacco mixture to saturated steam to provide an increase in the moisture content of at least 2 weight percent to the tobacco blend.

11. The process of claim 10, wherein the expansion step utilizes at least 0.25 pounds of the saturated steam at atmospheric conditions per pound of blended tobacco.

12. The process of claim 11, wherein the tobacco mixture is subjected to the saturated steam for at least 10 seconds.

13. A process for removing soluble material from tobacco comprising the steps of:

combining the tobacco and a first solvent to produce a first slurry;

removing most of the free solvent with dissolved solubles from the first slurry leaving saturated tobacco;

removing at least some of the dissolved solubles from the free solvent removed from the slurry;

adding a second solvent to the saturated tobacco producing a second slurry;

removing most of the free solvent with dissolved solubles from the second slurry leaving a saturated tobacco;

removing at least some of the dissolved solubles from the free solvent removed from the second slurry; and combining at least some of the free solvent removed from the second slurry with the tobacco as the first solvent added to the tobacco to be processed as the first slurry.

14. The process of claim 13, wherein:

the first slurry comprises from about 15 to about 30 pounds of first solvent to about 1 pound of dry tobacco; and, the saturated tobacco resulting from removal of free solvent from the first slurry comprises about 5.7 pounds of solvent to about 1 pound of dry tobacco.

15. The process of claim 13 comprising the additional step of agitating the first slurry to thoroughly mix its components.

16. The process of claim 13 further comprising the step of vibrating the first slurry and draining the free solvent from the vibrating first slurry.

17. The process of claim 13 further comprising the step of vibrating the second slurry and draining the free solvent from the vibrating second slurry.

18. The process of claim 13 wherein:

the second slurry comprises about 15 to about 20 pounds of second solvent to about 1 pound of dry tobacco; and, the saturated tobacco resulting from the removal of free solvent from the second slurry comprises about 5.7 pounds of solvent to about 1 pound of dry tobacco.

19. The process of claim 13 comprising the additional step of agitating the second slurry to thoroughly mix its components.

20. The process of claim 13 comprising the additional steps of:

adding a third solvent to the saturated tobacco producing a third slurry; and, removing most of the free solvent and absorbed solvent with dissolved solubles from the third slurry leaving a resulting tobacco product containing less soluble material than that of the tobacco before it was processed.

21. The process of claim 20 further comprising the step of removing at least some of the dissolved solubles from the free solvent removed from the third slurry.

22. The process of claim 20, wherein at least some of the free solvent removed from the first slurry is used as at least a portion of the third solvent added to the saturated tobacco to produce the third slurry.

23. The process of claim 20, wherein at least some of the free solvent removed from the third slurry is used as the second solvent added to the saturated tobacco to produce the second slurry.

24. The process of claim 20, wherein the third solvent comprises the free solvent removed from the first slurry and fresh solvent.

25. The process of claim 20, wherein:

the third slurry comprises from about 15 to about 20 pounds of third solvent to about 1 pound of dry tobacco; and, the resulting tobacco product comprises from about 1.5 to about 1.9 pounds of solvent to about 1 pound of dry tobacco.

26. The process of claim 20 further comprising the step of subjecting the third slurry to pressure to remove absorbed solvent from the tobacco.

27. The process of claim 20 comprising the additional step of agitating the third slurry to thoroughly mix its components.

28. An apparatus for removing soluble material from tobacco comprising:

(a) a first soluble material removing stage comprising:

an extraction tank in which tobacco to be treated is mixed with a first solvent to produce a first slurry;

means for supplying the first solvent to the extraction tank;

means for separating free solvent from the first slurry to produce saturated tobacco; and, means establishing slurry flow communication from the extraction tank to the free solvent separating means;

(b) a second soluble material removing stage comprising:

an extraction tank in which the saturated tobacco from the free solvent separating means of the first stage is mixed with a second solvent to produce a second slurry;

means for supplying the second solvent to the extraction tank;

means for separating free solvent from the second slurry to produce saturated tobacco;

means establishing slurry flow communication from the extraction tank to the free solvent separating means; and, means for circulating the free solvent from the second slurry to the first solvent supply means to be added to the extraction tank of the first stage as at least a portion of the first solvent.

29. The apparatus of claim 28 including a third soluble material removing stage comprising:

an extraction tank in which the saturated tobacco from the free solvent separating means of the second stage is mixed with a third solvent to produce a third slurry;

means for supplying the third solvent to the extraction tank;

means for separating free solvent and absorbed solvent from the third slurry to produce a resulting tobacco product; and, means establishing slurry flow communication from the extraction tank to the solvent separating means.

30. The apparatus of claim 29, further comprising means for disposing of that portion of the free solvent separated from the first slurry which is not circulated to the extraction tank of the third stage.

31. The apparatus of claim 29, wherein the means for separating absorbed solvent from the third slurry comprises means for pressing the third slurry.

32. The apparatus of claim 29, furher comprising means for circulating the solvent removed from the third slurry to the second solvent supply means to be added to the extraction tank of the second stage as at least a portion of the second solvent.

33. The apparatus of claim 29, further comprising means for circulating the free solvent from the first slurry to the third solvent supply means to be added to the extraction tank of the third stage as at least a portion of the third solvent.

34. The apparatus of claim 33, further comprising means for adding fresh solvent to the extraction tank of the third stage as a component of the third solvent.

* * * * *